US006715151B2

(12) United States Patent
Brockman

(10) Patent No.: US 6,715,151 B2
(45) Date of Patent: Apr. 6, 2004

(54) MANIPULATION SHIELD AND CONTAINMENT ENCLOSURE FOR INSPECTING CONTAMINATED MATTER

(76) Inventor: Robert Brockman, 2928 Elmwood Ave., Bakersfield, CA (US) 93305

( * ) Notice: Subject to any disclaimer, the term of this patent is extended or adjusted under 35 U.S.C. 154(b) by 39 days.

(21) Appl. No.: 10/199,595

(22) Filed: Jul. 19, 2002

(65) Prior Publication Data

US 2003/0150045 A1 Aug. 14, 2003

Related U.S. Application Data

(63) Continuation-in-part of application No. 10/074,657, filed on Feb. 14, 2002.

(51) Int. Cl.[7] ..... A41D 13/08
(52) U.S. Cl. ..... 2/16; 2/161.6; 135/95
(58) Field of Search ..... 2/16, 20, 160, 2/161.6, 161.7, 170; 135/95; 224/576

(56) References Cited

U.S. PATENT DOCUMENTS 3,354,922 A * 11/1967 James ..... 312/1
4,485,490 A * 12/1984 Akers et al. ..... 2/457
4,865,401 A * 9/1989 Jacobson ..... 312/1
5,671,983 A * 9/1997 Miller et al. ..... 312/1
5,704,670 A * 1/1998 Surplus ..... 294/25
6,203,080 B1 * 3/2001 Surplus ..... 294/1.3
6,539,549 B1 * 4/2003 Peters, Jr. ..... 2/16

* cited by examiner

*Primary Examiner*—Katherine Moran
(74) *Attorney, Agent, or Firm*—I. Michael Bak-Boychuk

(57) ABSTRACT

A transparent, thin film gloved envelope is provided to be worn on the hand and arm of a person during manipulations and/or examination of hazardous or noxious articles or matter. While the article is held in the gloved hand the sleeve or skirt that was covering the arms can be reversed and rolled over to cover the article and thereafter sealed to form an enclosing envelope. An erectable support skeleton is provided to support the membranes forming an enclosure to allow manual examination of the article contained. The envelope may be of a substantial size, provided with two dependent gloves for two-handed manipulation and examination, and a filtered orifice is provided together with a culture bed inside the enclosure. The suspended enclosure is then useful as an inexpensive examination and culturing chamber.

18 Claims, 4 Drawing Sheets

MANIPULATION SHIELD AND CONTAINMENT ENCLOSURE FOR INSPECTING CONTAMINATED MATTER

REFERENCE TO RELATED APPLICATIONS

This application is a continuation-in-part of the matter disclosed in U.S. application Ser. No. 10/074,657 filed on Feb. 14, 2002. Applicant claims the benefit of this earlier filing date for all matter common to this earlier application.

BACKGROUND OF THE INVENTION

1. Field of the Invention

The present invention relates to containment techniques and devices for hazardous matter, and more particularly to a flexible manipulation enclosure within which articles suspected to be contaminated can be confined, examined and thereafter stored.

2. Description of the Prior Art

Recent events have significantly affected the conduct of everyday life, particularly in those instances that are susceptible to mischief, sabotage or even terror. Amongst these are the ordinary delivery processes like the mail or parcel delivery which have been subverted for dissemination of hazardous matter to the public at large. The resulting potential for disruption of the ordinary processes of commerce has an enormous consequence on the whole economy, and the long-term effects cannot be overstated. As result, various techniques are currently sought to attenuate this threat.

A major aspect of any response to a chemical or biological hazard is the safe preliminary inspection, collection and storage of all articles that are suspected to have been contaminated, with the range of article suspects increasing with the virulence of the hazard. Good analytical processes dictate first an initial visual inspection which is then followed by further analysis of only those items that remain suspect after this observation. This selection and collection process is effected in organized, logical patterns in which the individual articles that need further analysis are marked, identified and separately enclosed to reduce any incidents of cross-contamination. Such analytical technique is then helpful in revealing both the source of the hazardous substance and the mechanism of its delivery, information that is critical in any response.

In the past various techniques and structures have been devised which in one manner or another shield the person that is engaged in manipulation of hazardous tasks or matter. Most frequently such shielding structures are exemplified by devices referred to as the "glove box" in which the user inserts his hands into the interior of a cavity through affixed rubber gloves. Exemplary glove boxes useful in shielding the person from hazards of sandblasting abrasion is described in U.S. Pat. No. 6,099,395 to Guseman; a sterile shielding structures useful in the course of surgical treatment of highly infectious maladies described in U.S. Pat. No. 5,316,541 to Fischer; an enclosure for containing welding gases in U.S. Pat. No. 5,685,771 to Kleppen; and others. Each of these, while suitable for the purposes intended, entails a generally complex and cumbersome enclosure that is therefore expensive. This expense limits the discardable aspects of the device, particularly in any inspection and sample collection process. Moreover, the complexity and physical size of these structures renders such less than fully useful for sealing and conveniently storing the inspected article until the suspicions regarding its contamination are resolved.

Of course, there are other instances where manipulative convenience is desired in a discardable enclosure. For example, those engaged in home repairs often need to manipulate and thereafter discard soiled plumbing pieces and the simple task of an automobile oil filter replacement requires manipulative grasping and sealed confinement of the filter that is then discarded. Thus there are numerous instances where shielded manipulation is desired and once effected the manipulated article needs to enclosed and discarded. An inexpensive, discardable and sealable manipulation shield which also allows for convenient visual inspection is therefore extensively sought and is one such shield that is disclosed herein.

SUMMARY OF THE INVENTION

Accordingly, it is the general purpose and object of the present invention to provide a transparent flexible gloved enclosure provided with a sealable opening and conformed for suspension on an erectile structure to allow visual examination of any article contained therein.

Other objects of the invention are to provide a flexible gloved enclosure extending from an enlarged transparent segment that is conformed to contain an article during visual examination.

Yet further objects of the invention are to provide a flexible tubular enclosure formed of a transparent polymer sheet, terminating at one end in a glove and including a sealable edge at the other end.

Additional objects of the invention are to provide a discardable manipulation shield that is also adapted to contain and seal the article manipulated.

Briefly, these and other objects are accomplished within the present invention by providing a flexible, reversible transparent glove formed to extend at its wrist opening from one end of a tubular enclosure provided with a sealable edge at its other end. Preferably both the glove and the enclosure are fabricated as a single piece with the enclosure defining a substantially larger envelope. With the user's arm inserted, the enclosure can then be turned inside-out and pulled over to surround any article grasped by the glove. Once so aligned to envelope the grasped article the sealable edge at the enclosure can then be closed, sealing the article therein. The article thus sealed can then be taken for analysis or can be collected for safe disposal.

Those in the art will appreciate that the foregoing glove and arm cover combination is particularly conformed as an inexpensive article that may be fabricated by heat stamping of any one of the several polymer sheet material structures like, for example, clear polyethylene film. Unlike the dexterity necessary for surgical procedures the function of the present inventive shielding structure needs to accommodate only such manipulations as may be necessary to lift and then visually examine the enclosed article suspected and the shielding envelope, therefore, can be effected in a form that is even less expensive than a surgical glove. The seal itself may be effected as a simple adhesive strip covered by ribbon that may be peeled off when sealing is desired, or may take the seal structure sold under the mark or symbol "ZipLoc" by S C Johnson. In this manner a convenient, inexpensive and therefore discardable shielding envelope is devised which is useful in a home to manipulate and visually inspect envelopes and packages delivered and also useful in hazardous substances or evidence collection.

For those applications where two handed grasping is necessary, as for example when lifting larger articles from ground, a plastic bag may be provided with a glove in each bottom corner, with the user's arms then extending through the bag to each glove. As before, the bag opening may include a sealing strip to effect a seal once the bag is turned inside-out and extended over the article.

In all its forms, and particularly in the last described configuration, the inventive shield is suited to form an inspection enclosure effected by way of an an exterior erectable skeleton, or by a released internal coil, supporting the enclosing membranes while the article contained therein is visually inspected. A HEPA or charcoal filter in one of the membranes accommodates any aspiration or gas exchange that may be associated with the deployment and stretching of the surfaces while retaining such particulate matter as may pose a hazard. Additionally, sealed bacterial culture beds may be exposed once the enclosure is erected to detect any bacterial contamination. The shield is thus fully useful to confine biological or chemical specimens and also for examination and nutrient bed multiplication of hazardous bacteria.

DESCRIPTION OF THE PREFERRED EMBODIMENTS

Figure 1:
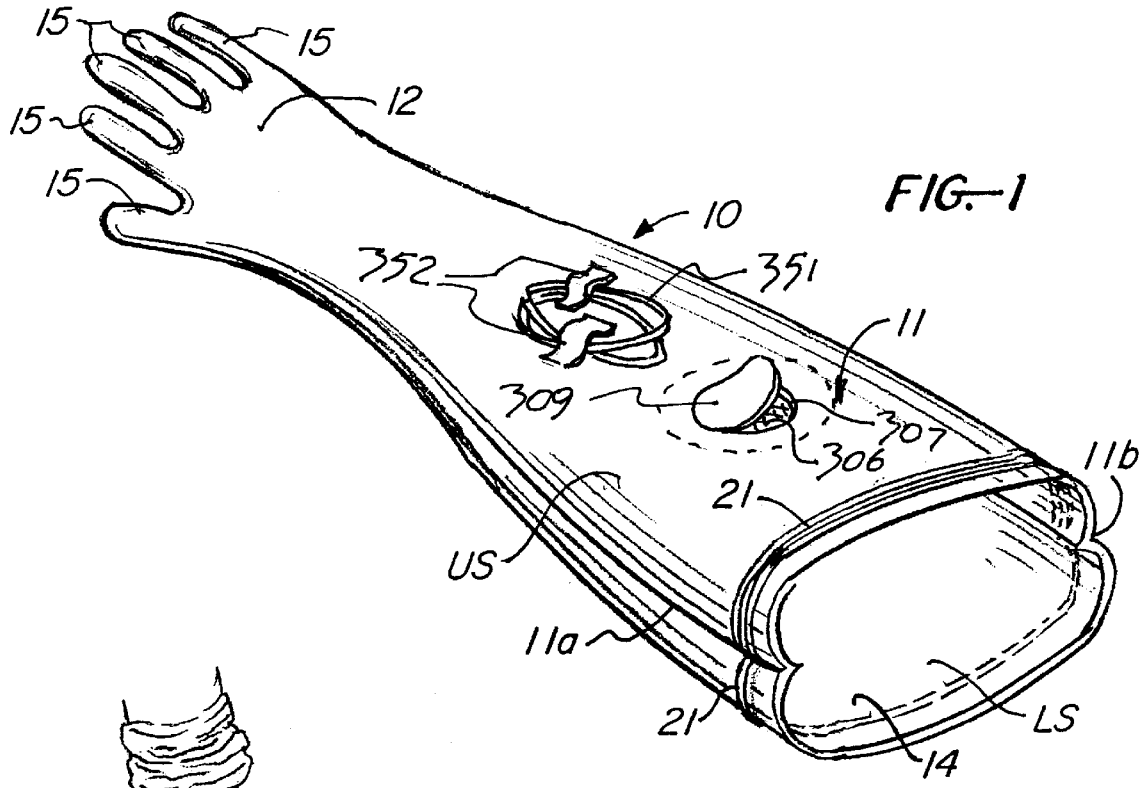
FIG. 1 is a perspective illustration of the inventive manipulation shield in its first implementation.
Figure 2:
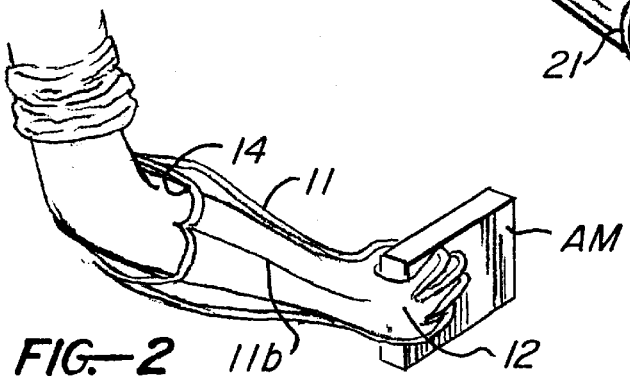
FIG. 2 is a further perspective illustration of the inventive manipulation shield shown in FIG. 1 deployed over the hand and forearm of a user.

As shown in FIGS. 1–5, the inventive manipulation shield, generally designated by the numeral 10, comprises a thin film sleeve 11 extending from the wrist opening of a thin film glove 12 both combined to form a loosely fitted common envelope for receiving the hand, wrist and forearm of a user. Both the glove and the sleeve may be formed from sheet polymer material structure, for example clear polyethylene sheet, by joining or heat welding the peripheral edges of the layered polymer sheeting to define both the glove 12 and the sleeve 11, the glove then further including individual finger envelopes 15 for each of the several digits of the hand. This manner of construction results in an inexpensive envelope or hand shield formed of a thin film that can be worn by a person when manipulating matter held by the gloved fingers. Once so used the sleeve 11 may be inverted and rolled down to extend over the gloved hand grasping any article or matter AM to surround and enclose the article and a sealing strip 21 on the interior of opening 14 into sleeve 11 is then useful to fully enclose the grasped matter. Once thus sealed off the user's hand may be withdrawn from the glove 12, leaving the article AM fully contained either for disposal or for laboratory examination.

Figure 3:
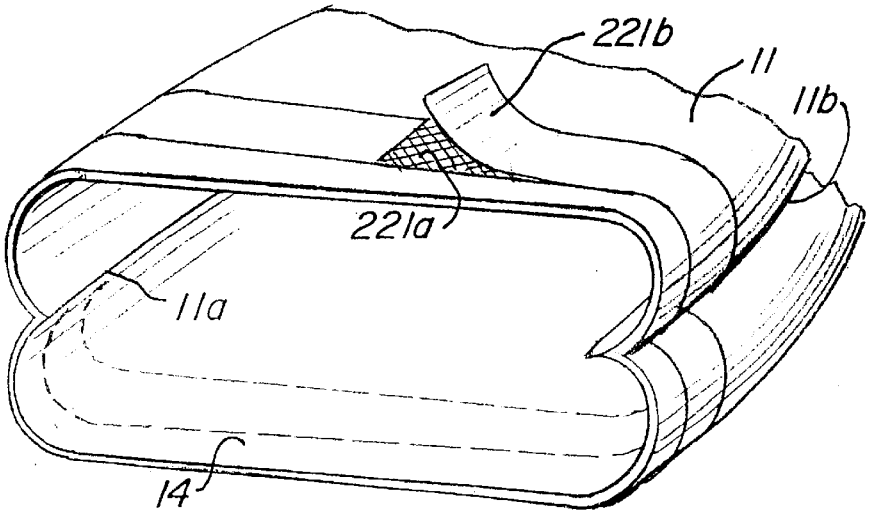
FIG. 3 is a detail view, in perspective, of an alternative sealing mechanism useful with the inventive manipulation shield.
Figure 4:
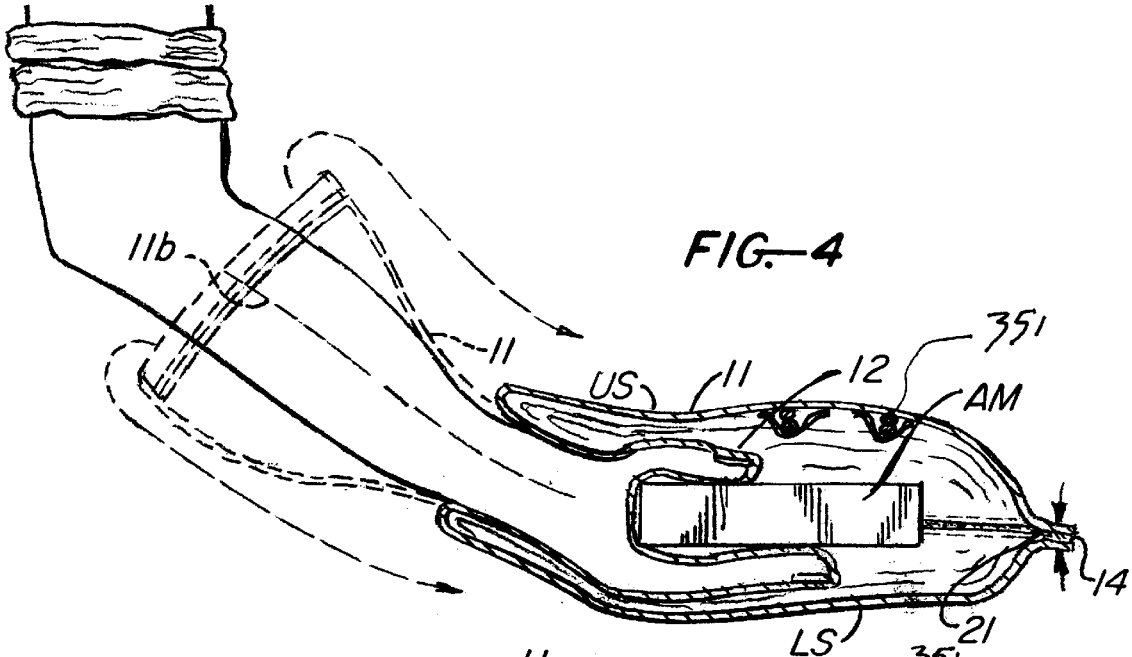
FIG. 4 is yet another perspective illustration of the inventive manipulation shield having a portion thereof inverted to surround an article grasped by the user.
Figure 5:
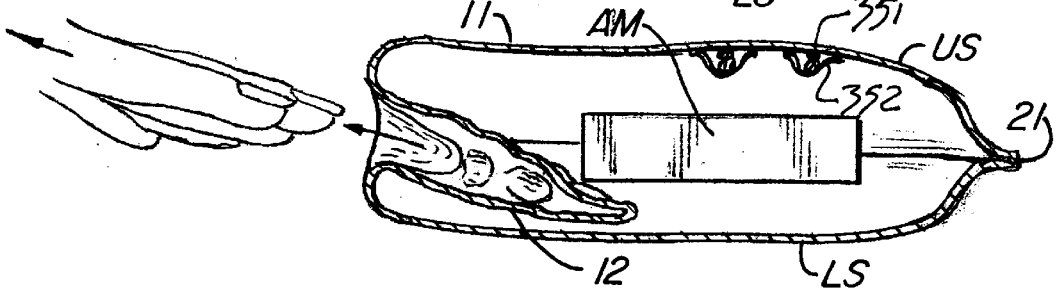
FIG. 5 is a sectional side view of the inventive shield deployed to contain an article suspected to be hazardous.

The general dimensions of the sleeve 11 and of the glove 12 extending therefrom are defined by longitudinal seams 11*a* and 11*b* joining an upper polymer sheet US to a lower sheet LS to each other to form a loose envelope for the arm and the hand, any excess longitudinal dimension of the sleeve being conveniently taken up in a plurality of folds. This general planform shape can further include excess transverse dimension in the sleeve 11 to render convenient the sleeve reversal process described above and to accommodate a variety of shapes and dimensions of the grasped article AM. To effect the sealing strip generally shown at 21 both the upper sheet US and lower sheet LS may include the interlocking beads 121 of a sealing mechanism sold under the mark ZipLoc aligned adjacent the edges forming opening 14. Alternatively, as shown in FIG. 3 an adhesive strip 221*a* covered by a peelable ribbon 221*b* may be utilized, again adjacent the edges of opening 14.

Those in the art will appreciate that the sealing closure of opening 14 needs to be effective only after the sleeve 11 is inverted and rolled down over the gloved hand grasping the article AM. Thus the interlocking sealing ribs 121, or strips 221*a* and their corresponding covering ribbons 221*b*, are deployed on the exterior surfaces of the sleeve 11 when it is worn on the user's arm. In the course of fabrication, however, the interlocking or sealing strips are positioned adjacent each other to assure proper sealing alignment and it is therefore contemplated that the course of fabrication is thereafter followed by a full inversion of the surfaces before vending. This both assures a good eventual seal and furthermore spreads the surfaces from each other in their vended form, thereby rendering convenient the use of the inventive shield.

Figure 6:
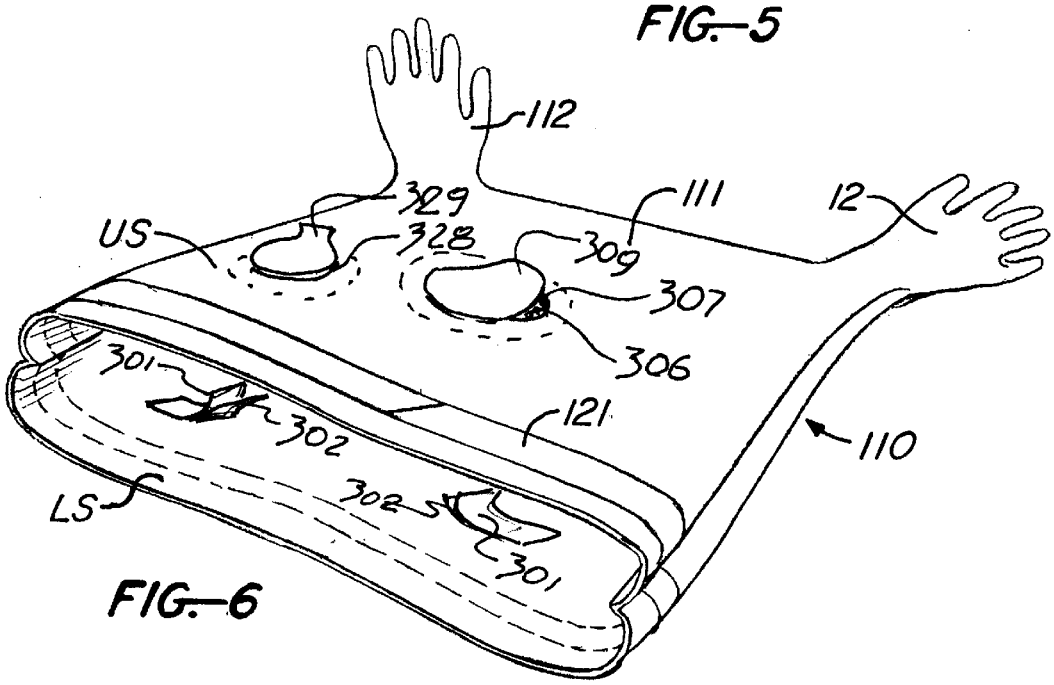
FIG. 6 is a perspective illustration of a further embodiment of the inventive manipulation shield conformed for confining articles requiring two-handed manipulation.
Figure 7:
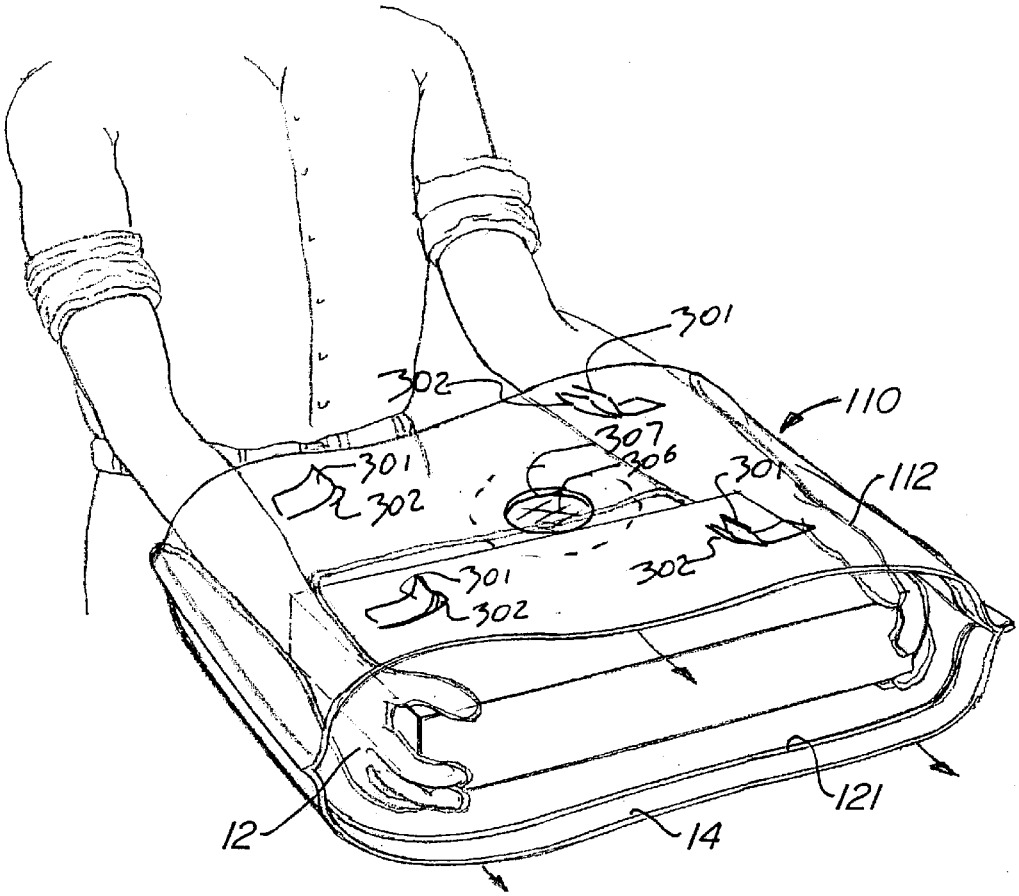
FIG. 7 is yet a further perspective view of the shield shown in FIG. 6 deployed to confine an article.

By further reference to FIGS. 6 and 7 an alternative implementation 110 of the inventive manipulation shield may include an enclosure of substantially larger dimensions useful in confining larger articles. Like numbered parts functioning in a like manner to that earlier described, this enclosure is once more effected by the surfaces of sleeve 11, this time enlarged as a rectangular envelope of substantial dimensions and designated by the numeral 111. As before envelope or sleeve 111 communicates with the glove 12 but because of the difficulty of one handed manipulation of larger articles a second glove 112 is also provided, gloves 12 and 112 being generally deployed at the respective corners of the envelope.

In the course of use the lower surface LS of envelope 111 is allowed to drape onto ground next to the article AM while the user's hands are received within the respective gloves 12 and 112. While thus shielded the user then rolls or otherwise manipulates article AM onto the lower surface LS of envelope 111 and thereafter seals it within the envelope by way of the above described sealing sequences of the interlocking ribs 121 or the exposed adhesive strips 221*b*. The article can then be further visually inspected through the transparent surfaces forming the enclosure 111, may be disposed or may be sent away for further laboratory examination.

In both forms the inventive shield 10 and/or 110 is particularly useful in handling questionable articles delivered by post or other public means of delivery. The recipient can thereby confine the questioned article in an envelope of substantial integrity and may either transfer same to such public agencies assigned to investigate, or may simply defer inspection until the suspicion of terrorist activity is fully resolved. Of course, the inventive shields are also useful to facilitate evidence collection or even as containers for collecting and disposing unsanitary objects or matter.

In both the above described forms the inventive structures provide immediate containment of suspect matter that may be offensive or even hazardous. The utility of this containment as a preliminary inspection enclosure or inexpensive glove box, or even as an enclosure in which suspect matter can be cultured, may be further effected by erection devices that support the enclosure's surfaces to form a sealed examination chamber, similar to a glove box, thus allowing for manipulative convenience of a gloved hand or hands in the interior thereof. To effect this surface suspension the surfaces of the shielding implementation 110, illustrated in FIGS. 6 and 7, may be provided with plural adhesive tabs 301 each with a peelable cover 302 extending from the upper and lower surface US and LS, each on the surface side that becomes exposed to the exterior when the suspected article AM is sealably contained.

Figure 8:
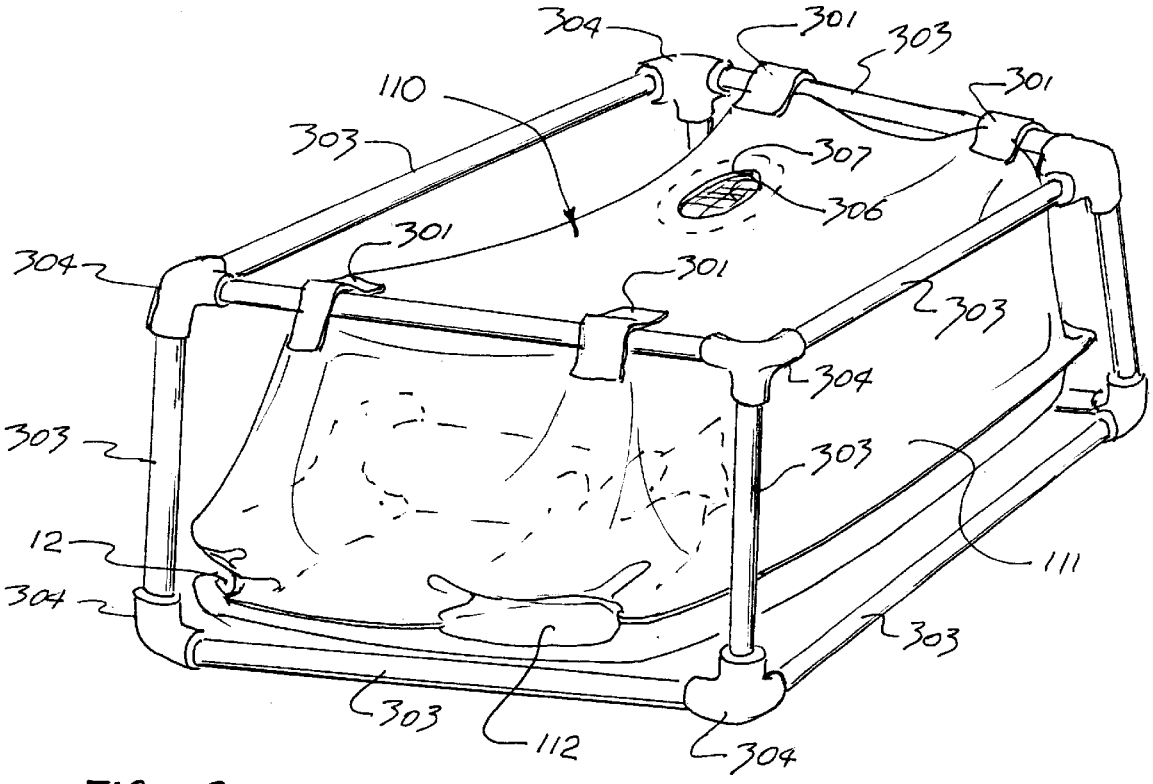
FIG. 8 is an additional perspective illustration of the inventive embodiment illustrated in FIGS. 6 and 7 engaged to an erectable exterior skeletal structure to form an inventive inspection enclosure.

As illustrated in FIG. 8 these adhesive tabs 301 can then be exposed from their peelable covers 302 to selectively engage one or more rods 303 of an erectable assembly that also includes orthogonal corner fittings 304 that engage the rod ends and hold them together. A three dimensional exterior support skeleton, generally designated at 310, is thus provided from which the transparent membranes that form envelope 111 are suspended, the suspended configuration then approximating a tent or chamber with appropriate ventilation through a HEPA or charcoal filter disc 306 adhered across an opening 307 in the upper surface US. The inspector's hands can then be again inserted into the gloves 12 and 112 to manipulate the enclosed article AM in the course of examination. Additionally, one or more culture beds 328 may also be provided on that side of the envelope membranes that becomes an interior surface when the article AM is confined, each culture bed being further covered by an adhesive layer 329 that can be subsequently stripped away to provide the culture nutrient to any biological processes that are included with the suspected article.

Figure 9:
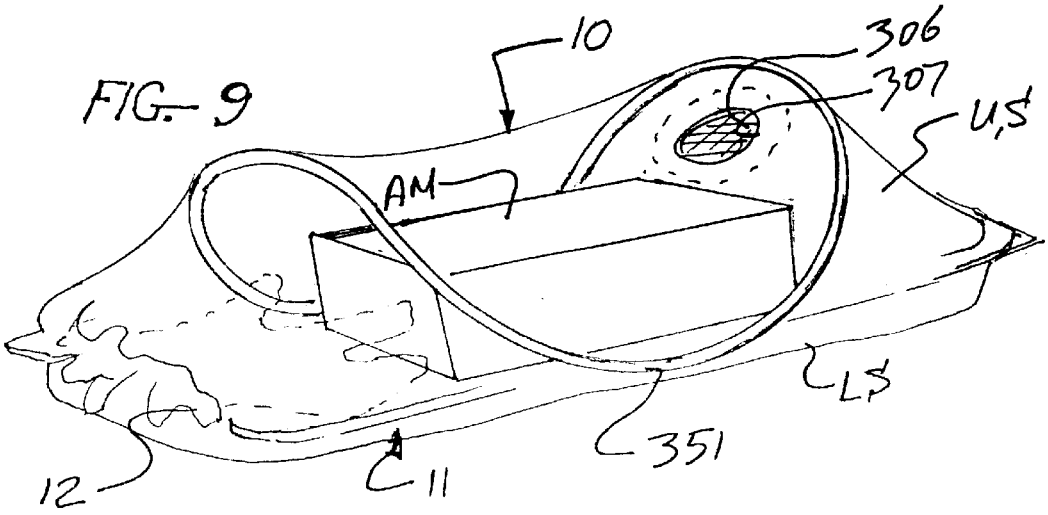
FIG. 9 is an illustration, again in perspective, of the inventive enclosure shown in FIGS. 1 through 5 extended into an examination enclosure by releasing a coiled interior element.

Similar erection of the first enclosure 10, illustrated in FIGS. 1 through 5, can be effected by way of a coiled wire hoop 351 fixed in its coiled form by adhesive strips 352 to those membrane surfaces of the sleeve 11 that end up on the interior with the article AM. Once the article is sealably confined the gloved hand of the user may release the hoop 351, to uncoil in the manner shown in FIG. 9, forming an interior support to the enclosure. The associated volumetric expansion of the enclosure is again enabled by the filter element 306, assuring biological isolation while accommodating gas exchange. The resulting chamber is then useful for convenient manipulation and examination of the suspected article.

Figure 10:
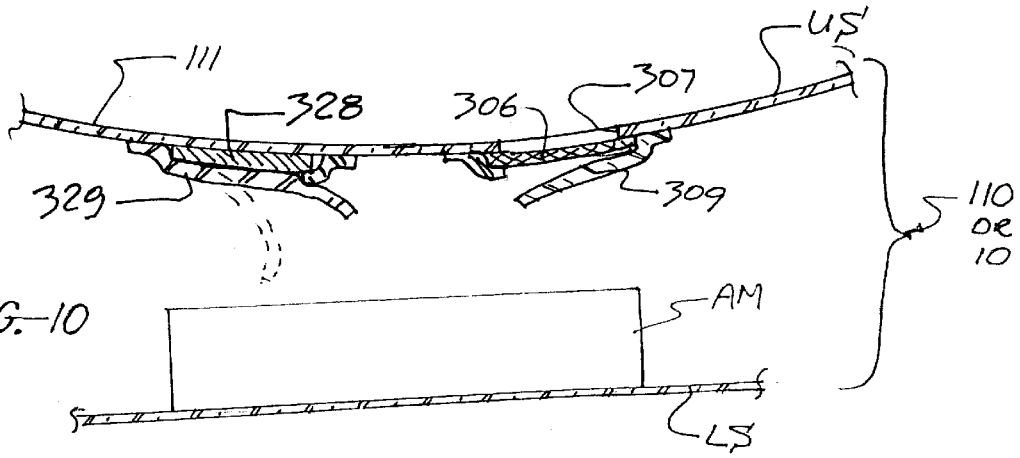
FIG. 10 is a detail illustration of a nutrient bed useful with the invention herein.

As illustrated in FIG. 10 both uses of the filter 306 in its opening 307 may be bridged by a flapper 309 to form a check valve that would limit any unwanted ejection of gas from the chamber interior. In this manner unwanted dispersal of chemical agents from article AM is kept to a minimum. In this manner an inexpensive container is expanded in its function into an examination and culturing enclosure that is particularly useful in the current setting of terrorism.

Obviously, many modifications and variations of the present invention can be effected without departing from the spirit of the foregoing teachings. It is therefore intended that the scope of the instant invention be determined solely by the claims appended hereto.

It is claimed:

1. A disposable thin film manipulation shield useful in the course of handling and inspecting an article, comprising:

a flexible glove provided with a first opening for receiving a hand of a person therethrough for grasping and manipulating said article;

a generally flexible transparent sleeve extending from said first opening and provided with a second opening conformed to receive the arm of said person extending towards said first opening;

an erectable structure releasably mounted on said sleeve; and sealing means deployed at said second opening and rendered effective upon the inversion of said sleeve and extension over said article, whereby the grasped article is sealably received within the cavity formed by the reversed common interior of said sleeve extending over the released erectable structure.

2. A transparent thin film inspection enclosure according to claim 1, wherein:

said sleeve further includes a filtered orifice.

3. A transparent thin film inspection enclosure according to claim 2, wherein:

said sealing means includes elongate bead strips adjacent said opening conformed for interlocked engagement upon the inversion of said sleeve.

4. A transparent thin film inspection enclosure according to claim 2, wherein:

said sealing means includes an elongate adhesive strip adjacent said opening aligned for adhesive engagement upon the inversion of said sleeve.

5. A transparent thin film inspection enclosure according to claim 4, wherein:

said adhesive strip is covered by a ribbon that is adapted to be peeled off.

6. A transparent thin film inspection enclosure according to claim 2, wherein:

said sleeve further includes a biological culture bed and a releasable sealing membrane covering said bed.

7. A thin film arm and hand covering useful in shielding a person while manipulating and inspecting an article that is suspected to be contaminated with hazardous or noxious matter, comprising:

a flexible transparent envelope defined by a flexible membrane having an interior and exterior surface and including an opening therein, said envelope extending distal of said opening to form a flexible glove, whereby said arm is receivable through said opening for insertion of a hand in said glove;

sealing means deployed on the exterior surface of said envelope adjacent said opening and rendered effective upon the inversion of said envelope to extend over said article to sealably enclose said article within the reversed common interior of said envelope and glove, such common interior being then defined by the reversed exterior surface; and a deployable erection structure conformed to suspend said membrane of said envelope to form an examination chamber.

8. A transparent thin film inspection enclosure according to claim 7, wherein:

said sleeve further includes a filtered orifice.

9. A transparent thin film inspection enclosure according to claim 8, wherein:

said sealing means includes elongate bead strips adjacent said opening conformed for interlocked engagement upon the inversion of said sleeve.

10. A transparent thin film inspection enclosure according to claim 8, wherein:

said filtered orifice includes check means for limiting the transmission of gases in the interior of said envelope to the exterior thereof.

11. A transparent thin film inspection enclosure according to claim 8, wherein:

said sleeve further includes a biological culture bed and a releasable sealing membrane covering said bed.

12. A transparent thin film inspection enclosure according to claim 7, wherein:

said sealing means includes an elongate adhesive strip adjacent said opening aligned for adhesive engagement upon the inversion of said sleeve.

13. A transparent thin film inspection enclosure according to claim 12, wherein:

said adhesive strip is covered by a ribbon that is adapted to be peeled off.

14. A thin film arm and hand covering useful in shielding a person during the course of manipulating and inspecting an article that is suspected to be contaminated with hazardous or noxious matter, comprising:

a flexible transparent envelope including an opening therein and extending distal of said opening in a flexible glove, whereby said arm is receivable through said opening for insertion of said hand in said glove;

sealing means deployed on the exterior of said envelope adjacent said opening and rendered effective upon the inversion of said envelope to extend over said article to sealably enclose said article within the reversed common interior of said envelope and glove; and a deployable erection structure conformed to suspend said envelope to form an examination chamber.

15. A transparent thin film inspection enclosure according to claim 14, wherein:

said envelope further includes a filtered orifice.

16. A transparent thin film inspection enclosure according to claim 15, wherein:

said envelope further includes a biological culture bed and a releasable sealing membrane covering said bed.

17. A disposable thin film enclosure useful in shielding the arms and hands of a person during the course of manipulating and inspecting an article that is suspected to be contaminated with offensive matter, comprising:

a flexible transparent envelope including an opening therein said envelope extending distal of said opening to form a plurality of flexible gloves, whereby said arms are receivable through said opening for insertion of said hands in corresponding ones of said gloves;

sealing means deployed on the exterior of said envelope adjacent said opening and rendered effective upon the inversion of said envelope to extend over said article to sealably enclose said article within the reversed common interior of said envelope and gloves; and a deployable erection structure conformed to suspend said envelope to form an examination chamber.

18. A transparent thin film inspection enclosure according to claim 17, wherein:

said envelope further includes a filtered orifice provided with check means for limiting the transmission of gases in the interior of said envelope to the exterior thereof, and a biological culture bed and a releasable sealing membrane covering said bed.

* * * * *